United States Patent [19]

Liu

[11] Patent Number: 4,663,000

[45] Date of Patent: May 5, 1987

[54] PROCESS FOR ELECTRO-DEPOSITION OF A DUCTILE STRONGLY ADHESIVE ZINC COATING FOR METALS

[75] Inventor: Chong T. Liu, West Nyack, N.Y.

[73] Assignee: Kollmorgan Technologies, Corp., Dallas, Tex.

[21] Appl. No.: 757,721

[22] Filed: Jul. 25, 1985

[51] Int. Cl.[4] ..... C25D 3/22

[52] U.S. Cl. ..... 204/55.1; 428/658; 428/659

[58] Field of Search ..... 204/55 R, 56 R; 428/658, 659, 632

[56] References Cited

U.S. PATENT DOCUMENTS

| | | | |
|---|---|---|---|
| 2,125,387 | 8/1938 | Mason | 204/56 R X |
| 2,132,438 | 10/1938 | Romig | 204/56 R |
| 2,847,373 | 8/1958 | Logan | 204/55 |
| 3,201,210 | 8/1965 | Harkins et al. | 428/658 X |
| 3,729,294 | 4/1973 | Hibbs | 428/658 X |
| 3,837,819 | 9/1974 | Hibbs | 428/658 |
| 4,243,496 | 1/1981 | Rosset et al. | 204/56 R |
| 4,386,139 | 5/1983 | Nakatsugawa | 428/658 X |
| 4,508,601 | 4/1985 | Nemoto et al. | 204/55 R X |
| 4,522,892 | 6/1985 | Shindow et al. | 428/659 X |
| 4,547,269 | 10/1985 | Raüsch et al. | 204/55 R X |

FOREIGN PATENT DOCUMENTS

| | | | |
|---|---|---|---|
| 802874 | 12/1968 | Canada | 204/56 R |
| 748210 | 10/1944 | Fed. Rep. of Germany | 204/56 R |

OTHER PUBLICATIONS

R. K. Braund et al., Trans. Faraday Soc., pp. 1595–1611, vol. 31, (1935).

Frederick A. Lowenheim, ed., *Modern Electroplating* 3rd Edition, pp. 442–460 John Wiley & Sons, New York (1974).

Ernest H. Lyons, Jr. *Transactions of the Electrochemical Society,* 78, pp. 317–338 (1946).

M. R. Thompson, "Acid Zinc Plating Baths", Transactions of the Electrochemical Society, 50, pp. 193–228 (1926).

G. B. Hogaboom and A. K. Graham "Andoes of Zinc Plating", *Transactions of the Electrochemical Society,* 61I, pp. 49–61 (1932).

E. H. Lyons Jr. "Acid Zinc Plating", *Transactions of the Electrochemical Society,* 80, pp. 387–405 (1941).

D. Povey and U. F. Marx, "Plating Zinc on Steel From Phyrophosphate Solution", *Review of the American Electroplating Soc.,* 46, pp. 70–75 (1946).

T. L. Rama Char., "Electroplating from the Pyrophosphate Bath", *Electroplating and Metal Finishing,* 10, 347 (1957).

T. L. Rama Char "Electroplating and Electrorefining of Metals from the Sulphamate Bath", *Electroplating and Metal Finishing,* 343 (1958).

A. E. Carlson and M. J. Krane, "High Speed Zinc Plating", *Rev. of the Am. Electroplaters Soc.,* 32, 1022 (1945).

T. R. Anantharaman et al., "Electrogalvanizing from Fluoborate Solution", *J. of the Electrochem Soc.,* 100, pp. 237–239 (1953).

*Primary Examiner*—G. L. Kaplan

*Attorney, Agent, or Firm*—Morgan & Finnegan

[57] ABSTRACT

The present invention relates an aqueous composition and process for electro-depositing at a pH of about 1 to 3.5, a ductile, highly adhesive, adsorptive and absorptive zinc coating on a metal article. The article with the electro-deposited zinc coating can be subjected to further treatment, such as, a second functional or decorative coating or painting and forming. The ductile zinc coating is resistant to cracking during forming and metal articles treated in accordance to the present invention, including the formed areas, are highly resistant to corrosion, stress corrosion cracking, wear and galling.

21 Claims, 8 Drawing Figures

SURFACE ELECTROPLATED WITH ZINC ACCORDING TO EXAMPLE 1 (4000x)

KOLSYL™ Zn

BENT SURFACE ELECTROPLATED WITH ZINC ACCORDING TO EXAMPLE 1 (50x)

KOLSYL™ Zn (Bent)

BENT SURFACE ELECTROPLATED WITH ZINC ACCORDING TO A COMMERCIAL ACID CHLORIDE PROCESS (50x)

Acid Cl Zn (Bent)

BENT SURFACE ELECTROPLATED WITH ZINC ACCORDING TO A COMMERCIAL CYANIDE PROCESS (50x)

Cyanide Zn (Bent)

BENT SURFACE ELECTROPLATED WITH ZINC ACCORDING TO A COMMERCIAL ALKALINE PROCESS (50x)

BENT SURFACE HOT-DIP GALVANIZED WITH ZINC (50x)

Hot-dip Galvanized Zn (Bent)

SURFACE ELECTROPLATED WITH ZINC ACCORDING TO A COMMERCIAL ACID CHLORIDE PROCESS (4000 x)

Acid Cl Zn

SURFACE ELECTROPLATED WITH ZINC ACCORDING TO A COMMERCIAL CYANIDE PROCESS (4000 x)

Cyanide Zn

PROCESS FOR ELECTRO-DEPOSITION OF A DUCTILE STRONGLY ADHESIVE ZINC COATING FOR METALS

INTRODUCTION

The present invention relates to an aqueous composition and process for electrodepositing a layer of ductile, adhesive, adsorptive and absorptive zinc coating on a metal article. The zinc coated metal article can be subjected to further treatment, such as, a functional or decorative coating or painting, and forming. The ductile zinc coating is resistant to cracking during forming, and the metal articles treated in accordance with the process of the present invention, including the formed areas, are, surprisingly, highly resistant to corrosion, stress corrosion cracking, wear and galling.

The process of the present invention is applicable to all conductive metal surfaces, but it is particularly important for difficult to coat metals such as ferrous metals, steels, stainless steels, copper, aluminum, nickel, chromium, titanium, and the like and alloys of these metals.

BACKGROUND OF THE INVENTION

Numerous methods have been used to prevent metals, particularly structural metals, from corroding in the atmosphere. The most commonly used methods include (1) barrier coating; and (2) cathodic protection, i.e. providing a "sacrificial" metal coating which is anodic to the metal substrate so that the "sacrificial" metal coating will be corroded before the metal substrate is attacked. Zinc has been widely used for this purpose, and may be applied in the form of a zinc rich paint on the metal substrate or by galvanization. Galvanization with zinc metal is the most commonly used method to improve corrosion resistance of ferrous metals and steels. Processes for galvanizing metal substrates include hot-dip, hot-spray and electrodeposition.

However, the zinc rich paints tend to contain nonconductive binders which coat the zinc particles and prevent the "sacrificial" galvanic reaction from proceeding. This undercuts the effectiveness of zinc rich paints as a protective coating. Galvanization by a hot-dip or hot-spray process consumes large quantities of energy and is very costly. Moreover, galvanization results in a brittle, macro-crystalline zinc coating which is difficult to form and will not accept paint except after the zinc surface has been treated by chromate conversion or phosphating.

It is known that zinc may be electroplated from acid solution at pH of about 3 to 4.5. See Frederick A. Lowenheim ed., *Modern Electroplating*, 3rd Ed., John Wiley & Sons, New York (1974), pp. 442–460. However, these acid zinc plating solutions have not been used extensively commercially to product zinc deposits having high ductility and good adhesion to difficult to plate metals. Without being bound by theory, it is believed that this is because these previous deposits are interfered with by the presence of detrimental inclusions in the crystal lattice, thus decreasing their ductility and adhesion characteristics. The zinc electrodeposited according to the present invention does not have these detrimental inclusions in the crystal lattice. Based on experiments none of the known acid zinc electroplating processes provide ductile deposits which can be bent or deformed and still provide sufficient corrosion resistance even when chromated.

It is also known that zinc coatings can be further treated. These treatment processes include phosphating and chromate conversion coating. Chromate conversion coating significantly improves the corrosion resistance of metal substrates which are galvanized or electroplated with zinc. Phosphating is used to improve adhesion of paints to galvanized surfaces. However, the chromate conversion and phosphating processes also result in brittle coatings which cannot be formed except with difficulty.

Metals are also surface treated to provide galling and wear resistance and lubricity. For example, metals have been coated with cadmium to provide the desired properties. However, cadmium is highly toxic and there are stringent federal and local regulations controlling its use. This increases the cost and limits its application.

Other methods of providing galling and wear resistance and improved lubricity include oxalate conversion coating, coating with fluorocarbon polymers and coating with electroless copper, nickel or hard chromium.

However, oxalate conversion does not provide corrosion resistance. The usable temperature range of fluorocarbon polymers is very limited and there tends to be excessive flow under stress. Therefore, it is not suitable for applications where the metal substrate is to be subjected to high temperatures and stress. Copper coatings induce corrosion of ferrous metal substrates. Electroless nickel and hard chromium coatings tend to break down under very high stress loads. Moreover, both are very hard coatings which provide wear resistance but poor galling resistance and lubricity. These disadvantages reduce the desirability of using these methods to provide simultaneously galling and wear resistance and improved lubricity.

Metal substrates may also be "siliconized" or implanted with phosphorus to improve their wear resistance. However, these processes are difficult to control, expensive and are impractical.

Another serious problem recently encountered is stress corrosion cracking of high strength alloys. These high strength alloys are used in satellites, space vehicles, airplanes, cars, bridges and nuclear reactors and are subjected to highly stressful environments. Stress failures have been the major causes of airplane and auto crashes, flaws in bridges and nuclear reactors. No viable solution was available to solve the stress cracking of high strength alloys until recently. A method of electroplating a zinc/silicon/phosphorus coating on high strength alloys to provide improved stress corrosion cracking resistance was described in co-pending application U.S. Ser. No. 641,557 (now U.S. Pat. No. 4,533,606) also assigned to the same assignee as this application.

Another area where the present invention has application is in the plating of difficult to coat metal substrates, such as aluminum, titanium and stainless steel. These metal substrates are difficult to coat because of the presence of a film of metal oxide on the surface. The metal oxide film can be removed by immersion in acidic or alkaline solutions. However, the oxide film reforms immediately when the metal substrate is removed from the de-oxidizing solution.

Phosphating with zinc oxide in phosphoric acid has also been used to improve adhesion of paints of difficult to coat metals. See U.S. Pat. No. 2,743,205. However, phosphating makes the surface very brittle, so that the treated metal article cannot be formed without losing corrosion resistance. Moreover, large quantities of sludge are produced in the process and must be properly disposed. Otherwise, there will be severe damage to the environment. Although methods to improve adhesion to difficult to coat metals are available, these generally involve a multiplicity of processing steps and high production costs.

It is desirable, therefore, to provide a simple method for improved adhesion on these metals.

In U.S. Ser. No. 641,557, owned by the same assignee, a composition and process for electroplating an adhesive zinc/silicon/phosphorus coating highly resistant to corrosion, stress corrosion cracking, wear and galling was described. However, the process is quite complicated, difficult, and time consuming.

It is, therefore, an objective of the present invention to provide an efficient and simple method to produce a ductile, adhesive zinc coating that has all of the desirable properties: resistance against corrosion, stress corrosion cracking, wear and galling and is formable.

It is a further objective of the present invention to provide an efficient and simple method to produce a ductile, adhesive zinc coating that has all of the desirable properties; resistance against corrosion, stress corrosion cracking, wear and galling and is formable, wherein the electroplating solution may be operated at room temperature, e.g., 15° C. to 35° C.

It is a further objective of the present invention to provide an efficient and simple method to produce a ductile, adhesive zinc coating that has all of the desirable properties; resistance against corrosion, stress corrosion cracking, wear and galling; and is formable to provide a coating surface which is dull and non-lustrous and is an excellent base for barrier coatings including paint, adhesives and other electrocoatings.

It is a further object of the present invention to provide a simple electroplating process to deposit an adhesive coating on difficult to coat metals to provide a substrate for accepting a desired coating.

BRIEF DESCRIPTION OF THE INVENTION

According to the present invention, a process has been developed for electrodepositing a ductile and adhesive zinc coating on various metal substrates, the process comprising:

(a) Preparing an aqueous electroplating solution comprising:
  (i) about 5 g to about 90 g per liter of zinc ions;
  (ii) an effective amount of a buffering agent to maintain a pH in the range of about 1.0 to about 3.5; and
  (iii) 0 to about 4 moles per liter of a conductive salt;
(b) Immersing a cleaned metal article in the electroplating solution; and
(c) Electrodepositing a ductile zinc coating, with the metal article as a cathode, at a current density of about 0.5 A/dm$^2$ to about 60 A/dm$^2$ for at least about 1 second.

The coating should be about at least 0.01 micron thick, preferably about 3 microns to about 5 microns thick.

Scanning electron microscope studies of a layer of about 15 microns show that the ductile and adhesive electroplated zinc coating comprises hexagonal, platelet-like crystals ranging in size from about 4 microns to about 8 microns along its longest axis. The platelet-like crystals are stacked face to face against each other. The ductile and adhesive electroplating zinc coating is also very adsorptive and absorptive. The zinc coating is receptive to adherent paint, lacquer or chromate deposits, and allows the paint, lacquer or chromate deposits to penetrate more deeply into the zinc coating, thereby promoting very strong adhesion to the metal substrate.

DETAILED DESCRIPTION OF THE INVENTION

Figure 1:
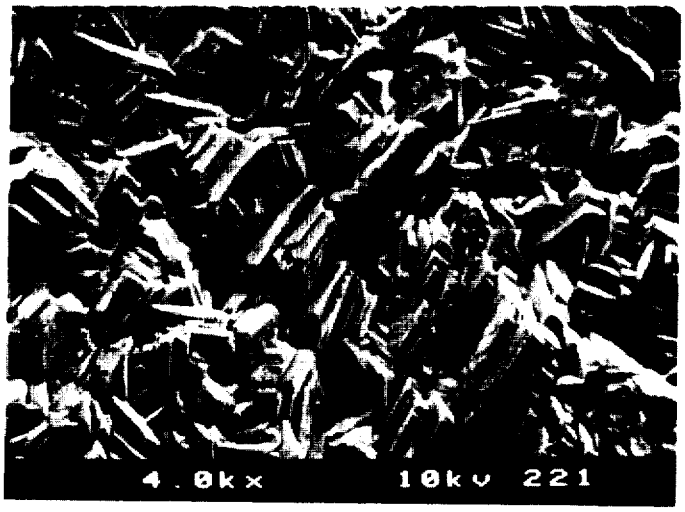
FIG. 1 is a scanning electron microscope picture of a layer of the ductile and adhesive electroplated zinc coating according to the present invention at 4000X.
Figure 2:
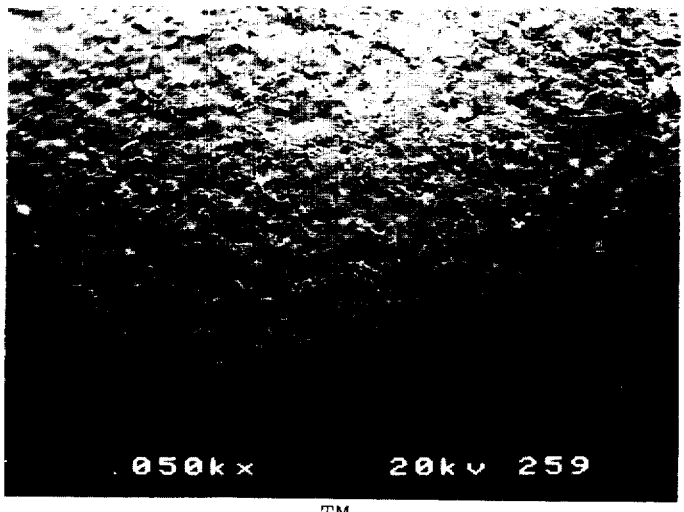
FIG. 2 is a scanning electron microscope picture of a bent layer of the ductile and adhesive electroplated zinc coating according to the present invention at 50X.
Figure 3:
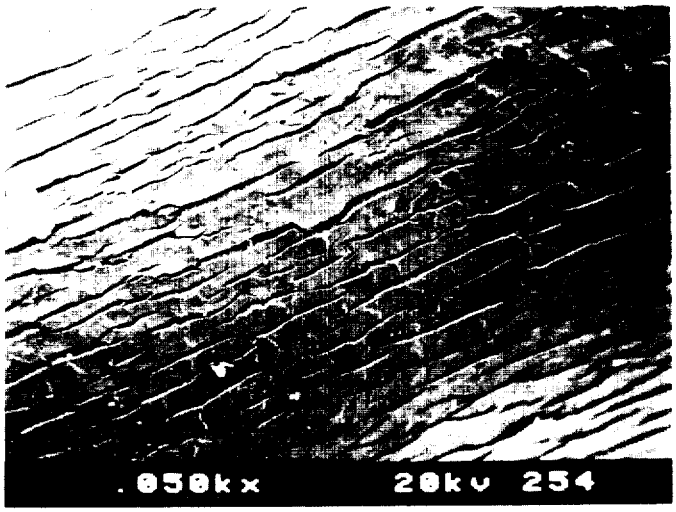
FIGS. 3–6 are scanning electron microscope pictures at 50X of zinc coatings on steel substrates formed or bent after plating electroplated from a commercial acid chloride process (FIG. 3); electroplated from a commercial cyanide process (FIG. 4); electroplated from a commercial alkaline process (FIG. 5); and from a commercial hot-dip galvanization process (FIG. 6).
Figure 4:
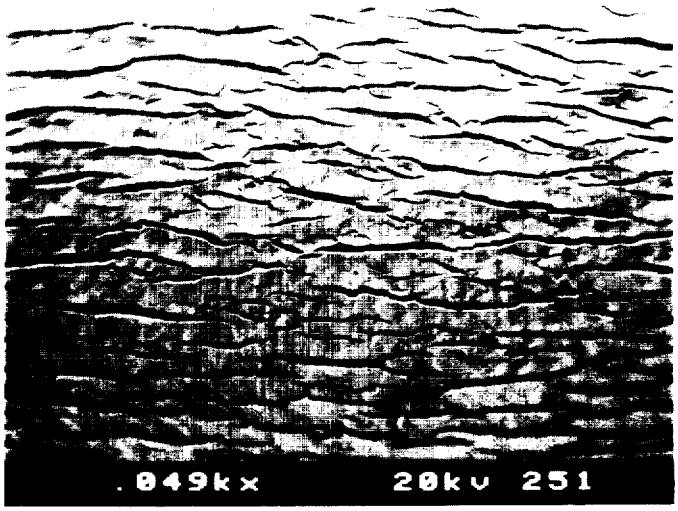
Figure 5:
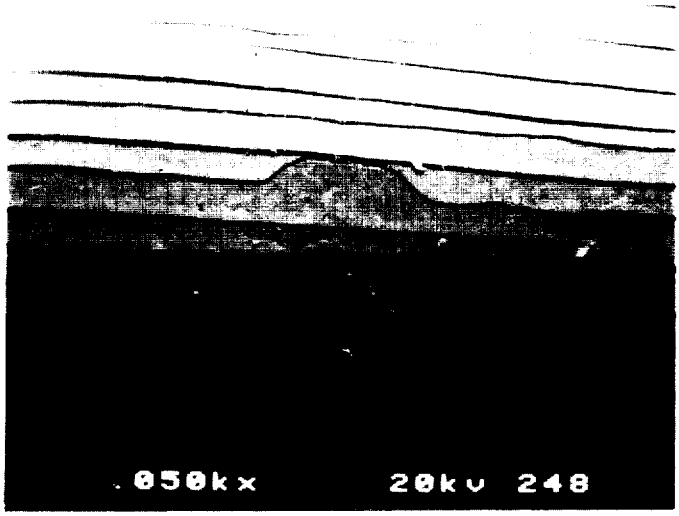
Figure 6:
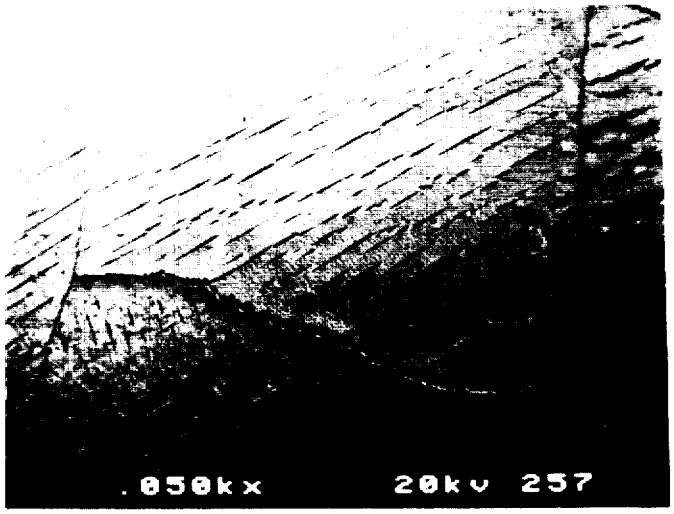
Figure 7:
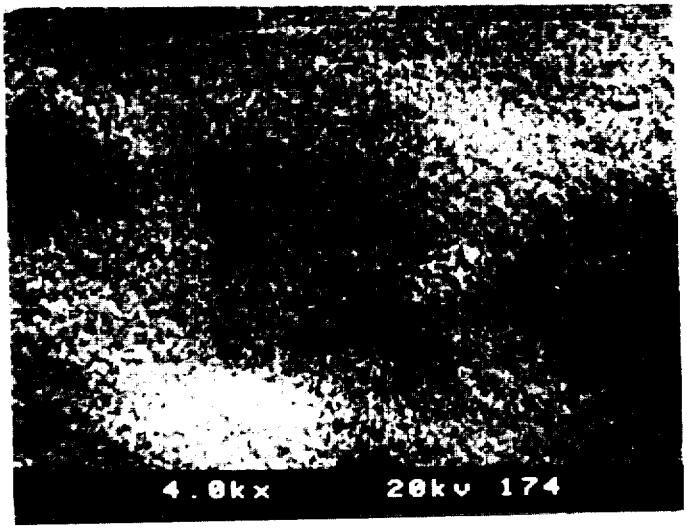
FIGS. 7–8 are scanning electron microscope pictures of zinc coatings electroplated from a commercial acid chloride process (FIG. 7); and electroplated from a commercial cyanide process (FIG. 8).
Figure 8:
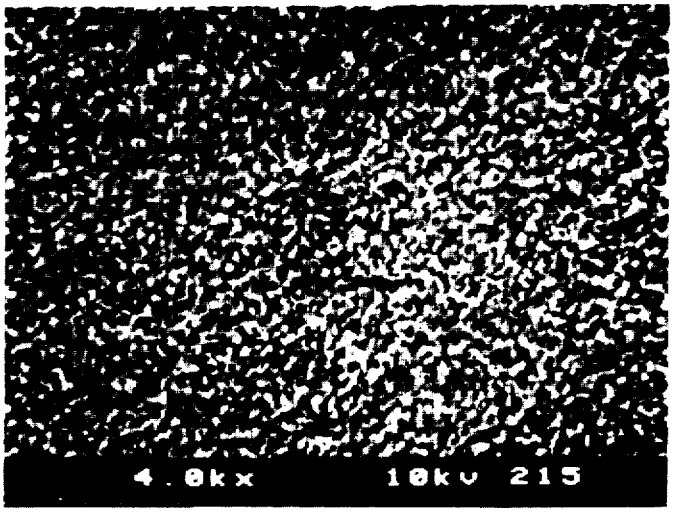

According to the present invention, aqueous solutions and processes for electrodepositing a layer of ductile, adhesive, adsorptive and absorptive coating of zinc on metal substrates have been provided.

The process for electrodepositing a layer of ductile, adhesive, adsorptive and absorptive zinc coating on metal substrates comprises:

(a) Preparing an aqueous electroplating solution comprising:
  (i) about 5 g to 90 g per liter of zinc ions;
  (ii) an effective amount of buffering agent to maintain a pH in the range of about 1.0 to about 3.5; and
  (iii) 0 to about 4 moles per liter of a conductive salt;
(b) immersing a cleaned metal article in the electroplating solution; and
(c) electroplating the metal article at a current density of about 0.5 A/dm$^2$ to 60 A/dm$^2$ for at least about 1 second.

The aqueous electroplating solution may be prepared by dissolving zinc in the form of zinc metal or zinc salts in concentrated phosphoric acid. The zinc salts may be selected from the group comprising zinc acetate, zinc carbonate, zinc oxide, zinc chloride, zinc sulfate, zinc sulfamate and zinc phosphate. The solution may be used in concentrated form or may be diluted with water to provide a solution containing about 5 g to about 90 g per liter of zinc ions and about 40 g to about 300 g per liter of phosphate ions, preferably 10 g to about 60 g per liter of zinc ions and about 100 g to 250 g per liter of phosphate ions.

The pH of the solution should be in the range of about 1 to about 3.5, preferably below 2.5, and most preferably below 2.0. The pH may be adjusted by using concentrated acids such as hydrochloric acid, phosphoric acid, or sulfuric acid and strong bases such as sodium, potassium, lithium hydroxide or ammonium hydroxide. It is to be noted that when the zinc ion concentration is low, i.e. in the range of about 5 g to about The mixture was diluted 1:2 with deionized water.

A Q panel was electroplated as in Example 1. The resulting zinc coating was observed to be similar to the coating of Example 1.

EXAMPLE 4

An electroplating solution was prepared using 25 g of zinc dust (Federated Metals Zn No. 1 from Federated Metals Corp., New York, N.Y.), 18 g of 85% phosphoric acid, 76 g of sodium dihydrogen phosphate, $NaH_2PO_4$, and 781 ml. of deionized water following the procedure of Example 1.

235 ml of the mixture was diluted with 259 ml of deionized water containing 2.8 ml of sodium silicate solution (STAR from The PQ Corporation, Philadelphia, Pa.). The pH was adjusted to 2.5.

Electrodeposition was carried out at a current density of 3 $A/dm^2$ and 6.7 volts. The cathodic efficiency was 88%.

EXAMPLES 5

Alternative formulations similar to that described in Example 1 are made using zinc salts other than ZnO. Thus, to replace 3.1 g of ZnO and 35.8 g of water given in Example 1, the following alternative raw materials are used: 4.8 g of zinc carbonate and 34.1 g of water, 5.2 g of zinc chloride and 33.7 g of water, 3.8 g of zinc hydroxide and 35.1 g of water, 6.1 g of zinc sulfate and 32.8 g of water or 7.0 g of zinc acetate and 31.9 g of water.

The procedure for preparing the concentrate formulations and the plating solutions as well as the plating conditions are all similar to those described in Example 1.

EXAMPLE 6

For comparison testing Q panels were electroplated using:

(a) acid chloride process (M&T 261 Bright acid chloride solution);
(b) alkaline zinc process (Harshaw Alka-Star 83);
(c) cyanide zinc process;
(d) a sulfuric acid process (zinc oxide in sulfuric acid at pH 2.8); and
(e) hot-dip galvanizing.

The panels were treated by chromate conversion process and bent to an angle of 135 degrees with a curvature of about 0.198 cm in diameter. The bent samples were examined by scanning electron microscopy. The coatings in the bent areas of the Q panels using procedures (a), (b), (c) and (e) were severely cracked.

The bent and chromated samples together with a Q panel electroplated and bent according to Example 1 were placed in a salt spray chamber for 260 hours.

The results are as follows:

| Q Panels | Estimated Percent of Corrosion | |
|---|---|---|
| | Flat Areas | Bent Areas |
| Example 1 (phosphate bath) | 0 | 0 |
| Example 9(a) (acid chloride) | 20 | 100 |
| Example 9(b) (alkaline zinc) | 0 | 10 |
| Example 9(c) (cyanide) | 50 | 90 |
| Example 9(d) (sulfuric acid) | 10 | 5 |
| Example 9(e) (hot-dip galvanization) | 0 | 40 |

The numbers represent visual estimates of percent of corrosion of the indicated areas.

X-ray mapping examination of the cross-section of the commercially galvanized, chromated samples prepared according to Example 9(a), 9(c), 9(d) and 9(e) together with the Q panel electroplated and chromated according to Example 1 were made.

The results were as follows:

| | Thickness in Microns | |
|---|---|---|
| | Zinc | Chromium |
| Example 1 | 12.8 | 7.68 |
| Example 9(a) | 12.8 | 0.512 est. |
| Example 9(c) | 12.8 | 0.512 est. |
| Example 9(d) | 12.8 | 5.12 |
| Example 9(e) | 12.8 | 0.512 est. |

These results indicated that chromium had penetrated about 8 microns into the zinc coating of the present invention and about 5 microns into the zinc coating using an acid sulfuric acid process and only about 0.5 microns into zinc coatings of commercial galvanizing processes.

EXAMPLE 7

Twenty Q panels were electroplated in a solution prepared as in Example 1, using a current density of 3 $A/dm^2$. Twelve of the panels were plated for 12.5 minutes to obtain a layer 6.4 microns of zinc coating and eight panels were plated for 23.0 minutes to obtain a layer of 12.8 microns of zinc coating. Eight of the panels with 6.4 micron layer zinc were chromated, four with yellow chromate solution (Allied Kelite Iridite 80) and four with olive chromate solution (M&T Unichrome 1072). The eight panels with 12.8 microns layer of zinc were also chromated, four with yellow chromate and two with olive chromate. There are thus two groups of ten panels, each group consisting of pairs of similarly treated panels. One of each pair of panels was bent 45 degrees.

All of the panels were then spray painted with a layer of epoxy primer, about 33 microns, and heat cured at 163° C. for 20 minutes. On each painted panel two crossing lines were scribed with a stainless steel stylus over the flat surfaces and the bent lines to expose the underlying steel substrate.

One group of ten panels, with five flat panels and five bent panels, was placed in a humidity chamber and the second group of ten panels, with five flat panels and five bent panels, was placed in a salt-spray chamber for 480 hours.

The results indicated that, in the humidity test, only one panel, the non-chromated, bent sample with 6.4 microns zinc showed undercuting of paint along the scribed lines near the bent line. All others showed little or no undercutting or blistering of paint.

In the salt spray chamber test, all samples showed slight or no undercutting.

25 g per liter, the pH should be in the range of about 2.5 to 3.5; when the zinc ion concentration is high, in the range of about 30 g to 90 g per liter, the pH should be about 1.5 to 2.5. It is believed that the presence of buffering agents permit the system to be buffered at these low pH ranges, so that the pH does not change significantly during the electrodeposition process and a uniform and even layer of zinc coating is achieved. Suitable buffering agents include phosphoric acid, ortho phosphoric acid, pyrophosphoric acid, chloroacetic acid, dichloroacetic acid, bromoacetic acid, other strong acids and their salts. The preferred buffering agent is orthophosphoric acid and dihydrogen orthophosphate salts.

In the electrodeposition process insoluble anodes, lead or previous metal coated titanium (DSA anode from Diamond Shamrock) as well as soluble anodes, e.g. zinc metal, may be used.

It has been found that the addition of conductive salts containing anions such as chloride, sulfate and fluoroborate ions increases the conductivity of the electroplating solution. This decreases the voltage required for the electroplating process. However, when an amount greater than 50 g per liter of chloride ion is added to the electroplating solution only soluble anodes, e.g. zinc metal may be used to avoid the evolution of significant amounts of chlorine gas. When sulfate or fluoroborate anions are used to increase solution conductivity, either zinc or insoluble anodes can be used.

The ratio of the area of the anode to the cathode is preferably about 1:1 or higher. The anode and cathode are preferably placed about 2.5 cm to 20 cm apart, most preferably 5 cm apart. The current density is about 0.5 $A/dm^2$ to about 60 $A/dm^2$, preferably about 5 $A/dm^2$ to about 40 $A/dm^2$.

Electrodeposition from a solution according to the present invention shows a cathodic efficiency of about 75% to 95%. At an optimum current density of 30 $A/dm^2$, a layer of about 6 microns is deposited on a metal substrate in about 1 minute.

The solution will electroplate the zinc coating of the present invention even when zinc is depleted down to 10 g per liter with a slight drop in pH. The depleted zinc can be replenished by using zinc oxide or a concentrated solution of zinc ions in phosphoric acid.

Metal articles electroplated in accordance with the above described method are provided with a zinc coating which is ductile and highly adhesive. The zinc coating is further characterized as comprising hexagonal platelet like crystals ranging in size from about 4 microns to 8 microns along its longest axis. The coated article can be formed into desirable structures and when further provided with a second protective coating, such as chromate conversion coating or paint, is surprisingly corrosion resistant. Even if the article is cut through to the base metal layer or bent at sharp angles, the combined coating is extremely corrosion resistant. Moreover, the zinc coating is highly adherent on difficult to plate metals such as stainless steels, aluminum, nickel, copper and the like.

The process for electroplating the zinc coating in accordance with the invention is illustrated in the following examples.

EXAMPLE 1

48.4 g of 85% phorphoric acid was introduced into a container. A slurry of 3.1 g of zinc oxide (AZO 55 from ASARCO) in 35.8 ml. of deionized water was slowly added with stirring to the phosphoric acid. The mixture was cooled and stirred to maintain a temperature of 65° C. to 70° C. until all of the zinc oxide had dissolved.

12.7 g of sodium hydroxide pellets were added with stirring and cooling. The mixture was allowed to cool to room temperature and the final volume was 67 ml. The mixture was then filtered. 50 ml. of the filtered solution was diluted with deionized water to 150 ml. The pH was adjusted to 2.8 with 50% sodium hydroxide. The solution contained about 14 g per liter of zinc ions and 196 g per liter of phosphate ions. Four panels of 1010 cold rolled steel, 76 mm×127 mm, (commercially available from Q-Panel Co., Cleveland, Ohio, hereinafter referred to as Q panels), were cleaned and immersed lengthwise up to 76 mm in the diluted solution. Both sides of the Q panel were electroplated at room temperature, using a DSA anode from Diamond Shamrock, at 3 $A/dm^2$ for 23 minutes. The thickness of the coating was 12–13 microns. A matt grey, non-lustrous coating was obtained.

The plated panel was rinsed with deionized water and dipped into an olive-drab chromate solution (M&T Unichrome 1072) for 60 seconds for chromate conversion coating treatment. The panel was then rinsed with deionized water and dried overnight. X-ray mapping examination of the cross-section of the panel showed the presence of chromium in the top 8 micron layer of the zinc coating.

The electroplated and chromated panel was then formed by bending in a brake to an angle of 135 degrees at a curvature of about 0.198 cm in diameter.

The panel was then tested in a salt-spray chamber (ASTM 117) for 260 hours. No signs of corrosion of the zinc coating or the underlying steel panel were observed.

EXAMPLE 2

An electroplating solution was prepared using 11.9 g of zinc oxide (a mixture of 4 g of AZO 55 and 7.9 g of AZO 66), 44.8 g of 85% $H_3PO_4$, 3.7 g of potassium hydroxide and 39.6 ml of deionized water following the procedure of Example 1.

The solution was diluted 1:2.4 with deionized water. 9.5 of sodium chloride was added and the pH was adjusted to 1.9 with sodium hydroxide pellets with stirring. The zinc ion concentration in the plating bath was 42 g per liter. Electrodeposition of zinc on Q panels was carried out at a current density of 3 $A/dm_2$, 1.6 V. for 20 minutes using a zinc anode. The cathodic efficiency was found to be 84%. The zinc plated Q panels were rinsed in deionized water, treated with M&T Unichrome 1072, rinsed in deionized water and air dried overnight. The samples were bent 135 degrees as described in Example 1 and tested in a salt spray chamber. No corrosion was observed after 200 hours of testing, either on the flat surface or at the bent line.

EXAMPLE 3

2.5 g of zinc dust (Grade 330 from Meadowbrook Corporation, Spelter, W. Va.) was added to a mixture of 48.4 g of 85% phosphoric acid and 23.7 g of water with slow stirring and heating to maintain a temperature of 80° C. to 90° C. After all of the zinc dust had dissolved, the solution was allowed to cool to room temperature.

12.7 g of sodium hydroxide pellets was dissolved in 12.7 ml. of deionized water. The sodium hydroxide solution was slowly added to the zinc in phosphoric acid solution mixture with cooling.

EXAMPLE 8

An electroplating solution was prepared using 317 g of zinc oxide (1:3 mixture of AZO 55 and AZO 66), 1191 g of 85% phosphoric acid, 1069 ml. of deionized water and 82.5 g of potassium hydroxide using the procedure described in Example 1.

The mixture was diluted to 5.5 liters with deionized water and the pH adjusted to 2.2. This gave a solution containing 46 g per liter of zinc ions and 178 g per liter of phosphate ions.

Eight cleaned Q panels were immersed into the diluted solution and electroplated using a current density of 30 A/dm$^2$ for 3 minutes to deposit a layer of zinc 12.5 microns thick. Four panels were treated with yellow chromate solution and four panels were treated with olive chromate solution as described in Example 7.

There are thus two groups of panels each consisting of two pairs of panels similarly treated. The eight panels were separated into two groups of four panels. One of each pair of the four panels was bent 45 degrees.

All of the panels were then spray painted with epoxy primer, about 33 microns, and heat cured at 163° C. for 20 minutes. On each painted panel, two crossing lines were scribed with a stainless steel stylus over the flat surfaces and bent lines to expose the underlying metal substrate.

One group of panels was placed in a humidity chamber for 480 hours and one group of panels was placed in a salt spray chamber for 480 hours.

The results indicated that there was little or no undercutting along the scribed lines or blistering in the humidity chamber, while there was slight undercutting along the scribed lines in the salt spray chamber.

EXAMPLE 9

Two copper sheets were cleaned with detergent, followed by mild etching with persulfate solution.

One of the copper sheets was electroplated at 3 A/dm$^2$ for 5 seconds with a zinc solution prepared as described in Example 1. The electroplated copper sheet was rinsed with deionized water and air-dried. A commercial, inorganic-based coating, Aremco 348 (from Aremco, Ossining, N.Y.), was applied on both copper sheets, to a thickness of 76 mm., using a brush. The sheets were then air dried overnight and baked at 82° C. for 30 minutes to set the coating. After cooling, both sheets were bent 90 degrees. The coating adhered to the copper sheet with the electroplated zinc coating; whereas the coating peeled from the copper sheet which was not electroplated with zinc.

The coated copper sheet with electroplated zinc was then subjected to heating at 500° C. for 30 minutes and then cooled to room temperature. There was only minor flaking of the inorganic-based coating. This shows that zinc electroplated on a metal substrate, according to the present invention, promotes strong adhesion of desired coatings on the metal substrate.

EXAMPLE 10

2 sheets of Nitronic 40 stainless steel (ARMCO, Middletown, Ohio) were cleaned with detergent.

The composition of this steel is:

| | % by weight |
|---|---|
| Carbon | 0.08 |
| Manganese | 8.00–10.00 |
| Phosphorous | 0.060 |
| Sulfur | 0.03 |
| Silicon | 1.00 |
| Chromium | 19.00–21.50 |
| Nickel | 5.50–7.50 |
| Nitrogen | 0.15–0.40 |

One of the steel sheets was electroplated at 3 A/dm$^2$ for 5 secs. with a zinc solution prepared as described in Example 1. The electroplated zinc sheet was rinsed with deionized water and air-dried.

The second steel sheet was electroplated at 3 A/dm$^2$ for 5 secs. with a copper solution consisting of $CuSO_4.5H_2O$ 90 per liter and $H_2SO_4$ (98%) 100 ml per liter. Both steel sheets were subjected to the pick test. This test involves etching away a portion of the electroplated metal to form a well-defined interface between the electroplated metal and stainless steel, and picking at the interface to dislodge mechanically the electroplated metal from steel.

Copper was readily removed from the surface. The electroplated zinc layer could not be removed.

We claim:

1. A process of electroplating a ductile and adhesive zinc coating comprising:
   (a) preparing an electroplating solution comprising:
      (i) about 5 g to about 90 g per liter of zinc ions;
      (ii) an effective amount of a buffering agent to maintain a pH in the range of about 1.0 to about 3.5, said buffering agent is selected from the group consisting of phosphoric acids, orthophosphoric acid, pyrophophosphoric acid and sodium dihydrogen phosphate; and
      (iii) 0 to about 4 moles per liter of a conductive salt;
   (b) immersing a cleaned metal article in the electroplating solutions; and
   (c) without forming a brittle phosphate coating, electrodepositing a ductile zinc coating, with the metal article as a cathode, at a current density of about 0.5 A/dm$^2$ to about 60 A/dm$^2$ for at least about a second.

2. A process according to claim 1 wherein the electroplating solution is operated at a temperature of about 15° to 35° C.

3. A process according to claim 1 wherein the buffering agent is phosphoric acid and sodium dihydrogen phosphate.

4. A process according to claim 1 wherein the electroplating solution is prepared by:
   (a) Dissolving zinc, selected from the group consisting of zinc metal, zinc oxide and zinc salts in 85% phosphoric acid in an amount which will result in a solution containing about 5 g to 90 g per liter of zinc ions, and about 40 g to 300 g per liter of phosphate ions with stirring and cooling to maintain the temperature of the mixture in a range of between room temperature to 100° C.; and
   (b) Adjusting the pH to about 1.0 to about 3.5 with alkaline hydroxide.

5. A process according to claim 4 wherein the alkaline hydroxide is selected from the group consisting of sodium, potassium, lithium and ammonium hydroxides.

6. A process according to claim 4 wherein the zinc salt is selected from the group consisting of zinc acetate, zinc carbonate, zinc chloride, zinc sulfate, zinc phosphate and zinc sulfamate.

7. A process according to claim 1 wherein the zinc ions are derived from zinc oxide.

8. A process according to claim 1 wherein the pH is adjusted with alkaline hydroxide.

9. A process according to claim 8 wherein the alkaline hydroxide is selected from the group consisting of sodium hydroxide and potassium hydroxide.

10. A process according to claim 8 wherein the zinc ion concentration in the electroplating solution is from about 35 g to about 60 g per liter.

11. A process according to claim 1 wherein the conductive salt is selected from the group consisting of chloride salts, sulfate salts, and fluoroborate salts.

12. A process according to claim 1 wherein the zinc ion concentration in the electroplating solution is from about 5 g to 25 g per liter and the pH is about 2.5 to 3.5.

13. A process according to claim 1 wherein the zinc ion concentration in the electroplating solution is from about 30 g to about 90 g per liter and the pH is about 1.5 to 2.5.

14. A process according to claim 1 wherein the current density is about 5 $A/dM^2$ to 50 $A/dM^2$.

15. A process according to claim 1 wherein the current density is about 10 $A/dM^2$ to 40 $A/dM^2$.

16. A process according to claim 1 wherein the plating time is about 1 to about 45 minutes.

17. The process according to claim 1 wherein the plating time is about 1 to about 5 minutes.

18. A process according to claim 1 wherein the metal article is selected from the group consisting of stainless steel, aluminum and nickel without activation of the cleaned metal article.

19. A process of electroplating a ductile and adhesive zinc coating comprising:

(a) Preparing an electroplating solution comprising:
  (i) about 5 g to about 90 g per liter of zinc ions; and
  (ii) about 40 g to 300 g per liter of phosphate ions as a buffering agent to maintain a pH in the range of about 1.0 to 3.5, (b) Immersing a cleaned metal article in the electroplating solution; and (c) Electrodepositing a zinc coating, with the metal article as a cathode, at a current density of about 0.5 $A/dm^2$ to about 60 $A/dm^2$ for at least about one second at a temperature of about 15° C. to about 35° C.

20. A process according to claim 19 wherein the electroplating solution comprises:

(i) about 10 g to about 60 g per liter of zinc ions;

(ii) about 100 g to about 250 g per liter of phosphate ions at a pH below about 2.4.

21. A process according to claim 19 wherein the pH of the electrodepositing solution is below about 2.0.

* * * * *

UNITED STATES PATENT AND TRADEMARK OFFICE

CERTIFICATE OF CORRECTION

PATENT NO. : 4,663,000

DATED : May 5, 1987

INVENTOR(S) : Chong Tan Liu

It is certified that error appears in the above-identified patent and that said Letters Patent is hereby corrected as shown below:

Column 5, line 17, delete "previous" and insert therefor --precious--.

Column 6, line 48, delete "$dm_2$" and insert therefor --$dm^2$--.

Column 7, line 21, delete "Examples" and insert therefor --Example--.

Signed and Sealed this

Twenty-first Day of June, 1988

*Attest:*

DONALD J. QUIGG

*Attesting Officer*

*Commissioner of Patents and Trademarks*